United States Patent [19]

Heyland

[11] 4,054,343

[45] Oct. 18, 1977

[54] PRESCRIPTION DRUG-DISPENSING APPARATUS

[76] Inventor: Gary Heyland, 7718 Lewis Pasteur Drive, San Antonio, Tex. 78229

[21] Appl. No.: 669,761

[22] Filed: Mar. 24, 1976

[51] Int. Cl.[2] ..... A47F 5/08; B01L 9/02

[52] U.S. Cl. ..... 312/209; 206/362; 312/234.1

[58] Field of Search ..... 312/38, 39, 42, 196, 312/234.1, 234.5, 209, 283, 250; 116/121; 206/362, 370, 484, 539; 211/46

[56] References Cited

U.S. PATENT DOCUMENTS

| | | | |
|---|---|---|---|
| 620,013 | 2/1899 | Barnes | 312/283 |
| 2,847,119 | 8/1958 | La Padura | 206/362 |
| 2,888,306 | 5/1959 | Sease et al. | 312/196 |
| 3,380,578 | 4/1968 | Sparks | 206/484 |
| 3,715,148 | 2/1973 | Bealls | 312/209 |
| 3,915,526 | 10/1975 | Weiman | 312/209 |
| 3,931,885 | 1/1976 | Nahill et al. | 116/121 |
| 3,969,006 | 7/1976 | Brown | 312/209 |

*Primary Examiner*—Casmir A. Nunberg

[57] ABSTRACT

The present invention includes a cassette-type dispenser for use in the dispensing of drugs contained in strip packages. The cassette-type dispenser is filled periodically by a pharmacy to contain a particular type medication for a patient. The medication is sufficient for a pre-determined period of time such as a 1-month supply. Additional cassette-type dispensers may be used for other types of medication for the same patient. The cassette dispenser is color coded to indicate the time intervals at which the medication is given to the patient. All of the medications for the cassette-type dispensers are located in a portable cart, along with various medications similarly dispensed for other patients. The portable cart is designed for use in facilities such as hospitals or nursing homes with all of the prescription-type drugs being contained under lock and key, and all of the control drugs being contained under double lock and key. Other shelves on the portable cart contain liquid medication, ointments, injectable type of drugs or other typical items needed while dispensing medication. By using the cassette-type dispensers in conjunction with the portable cart, an attendant may easily dispense all of the required drugs for each patient in a facility such as a nursing home.

2 Claims, 3 Drawing Figures

PRESCRIPTION DRUG-DISPENSING APPARATUS

BACKGROUND OF THE INVENTION

This invention relates to a drug dispensing apparatus and, more particularly, to a cassette-type dispenser for dispensing strip packaged drugs. The cassette-type dispenser is used in combination with a portable cart for the dispensing of all prescriptions, controlled drugs, or other medication needed by patients in a facility such as a nursing home. All of the cassettes dispensers are color coded to indicate the time to give drugs being dispensed to the patients. The cart has separate storage facilities for liquid medication, ointments, injectable medication, or other types of drugs.

BRIEF DESCRIPTION OF THE PRIOR ART

Prior to the present invention, any types of drug-dispensing mechanisms have been devised for use by the general public and/or hospitals and nursing home facilities. Many of these dispensing mechanisms were primarily concerned with preventing a patient from taking an excessive dosage. Very little concern was paid to the ease of the dispensing of the large number of drugs that must be given in a facility such as a nursing home. The average patient in a nursing home takes between four and five different types of prescription drugs per day. Many of these drugs must be contained under at least a single lock and key, and some under double lock and key as prescribed by federal statute. Many times a problem will arise from a patient receiving too much of a particular type of medication, someone else's medication, or receiving no medication at all. Normally, these problems arise from confusion over the particular type of medication to be given, to whom it is to be given, and when it is to be given. The attendants must give numerous medications to so many different patients that confusion will inevitably occur under the prior methods of dispensing medication.

A prior problem encountered in previous cassette-type dispensers of strip drugs is related to the large number of different sizes of pills or other medication being dispensed, plus different widths of strips on which the medication is located. Most of the prior cassette dispensers simply handle one particular size strip and one size tablet for dispensing. Also, many of the prior cassette-type packages are not designed for reuse, but are simply thrown away after using the contents of the particular package. The packaging normally has no correlation with the number of times the prescription would be given over a particular time period.

Former types of dispenser carts were simply provided as a means for moving the medication from the storage cabinet to the bedside of the various patients. The dispensing cart was not the storage cabinet for all prescription and control-type drugs that were required to be kept under lock and key. No thought was given to making a combined dispensing cart and storage cabinet for containing all the medication required over a given time period for all the patients of a particular facility such as a nursing home. Also, no thought was given to having individual dispensing mechanisms for each of the medications of each patient thereby reducing the possiblity of confusion, confusion that could result in a patient not receiving the proper medication, especially when large amounts of drugs are being dispensed to numerous patients.

SUMMARY OF THE INVENTION

Therefore, it is an object of the present invention to provide a individualized drug-dispensing mechanism for dispensing a given medication for a particular patient over a given period of time.

It is another object of the present invention to provide a refillable cassette-type dispenser for any strip packaged medication of any particular patient, which cassette-type dispenser may be reused and refilled by a pharmacy. The cassette-type dispenser contains a sufficient amount of medication for the particular patient to last a given time period. The cassette-type dispenser is particularly designed to handle essentially all sizes of medication as located on essentially all strip packaged drugs.

It is yet another object of the present invention to provide a portable cart unit for containing all cassette-type dispensing mechanisms for all patients in a given facility such as a nursing home. The portable cart is designed to receive the cassette-type dispensers as well as liquid medication, ointments, or injectable medication, all of which could be easily dispensed to the patient, and still contained under lock and key as required by federal regulation.

It is another object of the present invention to provide a portable dispensing cart having shelves for receiving cassette-type dispensers. The cassette-type dispensers are divided according to the patients, and are color coded to indicate the amount of medication given to each patient. Also, the portable cart would have a double lock unit contained therein in which controlled drugs being prescribed to the patients may be located. Other shelves and containers inside of the portable cart contains the liquid medication, ointments, injectable medications or other items necessary to dispense the medications used by the various patients. All of the medications given are easily verified by a record book carried on a swivel-type holder on the top of the portable cart. To add additional capacity to the cart, lockable doors are located on either side of the cart so that medication can be dispensed from either side of the cart.

DESCRIPTION OF THE PREFERRED EMBODIMENT

Figure 2:
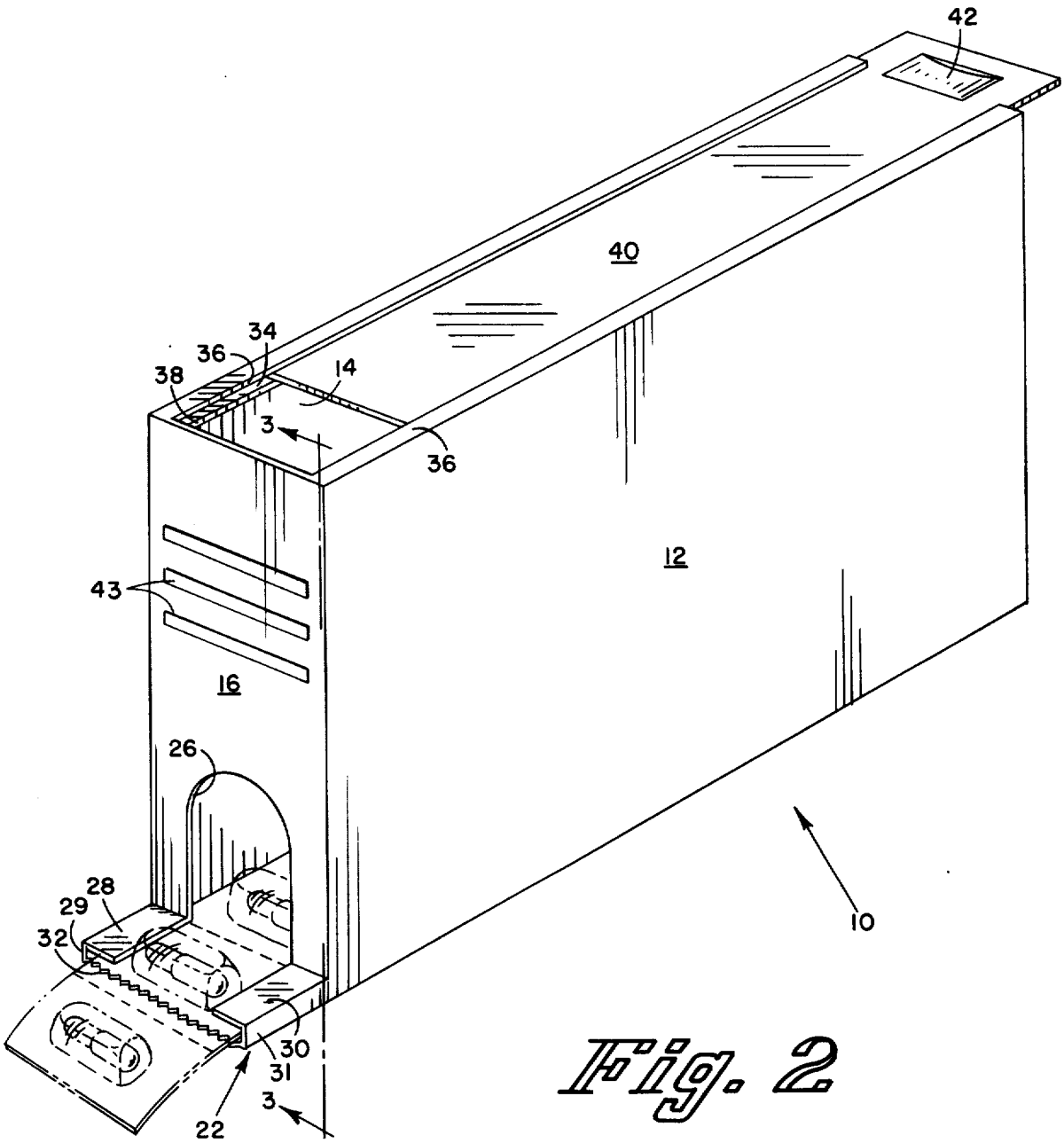
FIG. 2 is a perspective view of a cassette-type dispensing unit used in FIG. 1 for strip packaged medication.
Figure 3:
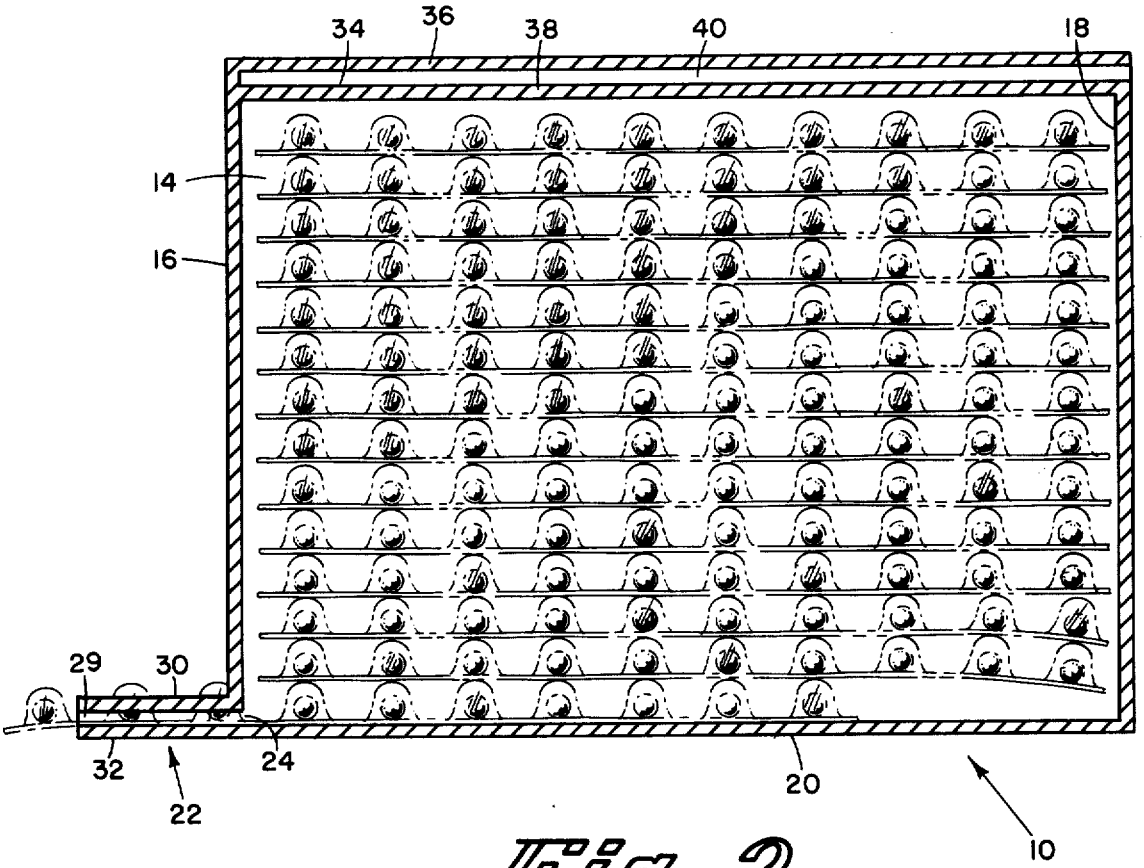
FIG. 3 is a cross-sectional view of FIG. 2 taken along section line 3—3 with the cover in the closed position.

Referring to FIGS. 2 and 3 in combination, there is shown a cassette-type dispenser represented generally by the reference numeral 10. The casette-type dispenser 10, while it may be made from any particular substance, is molded from plastic in the preferred embodiment. The plastic may be clear for easy viewing through the dispenser 10, or it may be colored according to the preference of the manufacturer.

As a general description of the cassette-type dispenser 10, it has sidewalls 12 and 14 that are bonded to a frontwall 16 and a rearwall 18. Both of the sidewalls 12 and 14, and the rearwall 18, are bonded to a base 20.

The front portion of the base 20 extends beyond the frontwall 16 to form part of a dispensing tab 22. There is a space 24 between the lowermost portion of frontwall 16 and the base 20. The space 24 is approximately ⅛th of an inch or less. Also, in the lowermost portion of the frontwall 16 is located an opening 26 that is large enough for a finger to extend therethrough to pull strip medication through the opening 26 as will be subsequently described. Extending forwardly from the lowermost portion of the frontwall 16 are a pair of overlapping flanges 28 and 30. These overlapping flanges 28 and 30 connect via sides 29 and 31 to the base 20 thereby forming a portion of the dispensing tab 22. The overlapping flanges 28 and 30, in conjunction with the base 20, form a channel through which strip medication is held into position as shown in FIGS. 2 and 3. The frontmost portion of the base 20 forming a portion of the dispensing tab 22 has a serrated edge 32 to tear individual medication packs off of the strip package. The overlapping flanges 28 and 30 are at least a quarter of an inch wide to accommodate varying sizes of strip packaged medication and still hold the strip package against the base 20 and the serrated edge 32.

Both of the sidewalls 12 and 14 have a channel 34 formed at the upper portion thereof by upper inwardly extending flanges 36 and lower inwardly extending flanges 38. A removable cover 40 is slidably received between the upper inwardly extending flanges 36 and lower inwardly extending flanges 38 at the upper rear portion of the dispenser 10. A finger indentation 42 aids in ease of removal of the cover 40. It should be noted that the rearwall 18 is slightly lower than the frontwall 16 to allow the removable cover 40 to be received into the channel 34 above immediately above the rearwall 18.

The cassette-type dispenser 10 is particularly designed to accommodate all common types of strip packaged medication which may have varying sizes of pills or tablets contained therein. The width of the strips of strip packaged medication may vary by as much as one quarter of an inch. Therefore, the overlapping flanges 28 and 30 are at least a quarter of an inch wide to accommodate the varying widths of the strip packaged medication that may be dispensed through dispenser 10. Also, it is important that the opening 26 be large enough so that a finger may be inserted therein to pull the strip packaged medication through the opening 26 as well as removing the finger.

In using the cassette-type dispensers 10, a pharmacist can fill a particular prescription for a patient that would be enough to last for a predetermined period of time for that particular patient, such as a one month supply of medication. Normally, the strip packaged medication comes in strips of ten that can be inserted through the top by removing the removable cover 40. The strips would lay flat as indicated in FIGS. 2 and 3. The medication is removable through the front opening 26 for dispensing to the patient.

If the cassette-type dispenser 19 is used in a large facility such as a hospital or a nursing home, strips of colored tape 43 may be located on the front of the dispenser 10 with the strips of colored tape indicating the time of day the medication should be given. For example, in nursing homes medication is normally given at 8:00 a.m., 12:00 noon, 4:00 p.m., and 9:00 p.m. If the medication contained in the dispenser 10 is to be given only one time per day, a colored strip (such as red) is located on the front of the dispenser indicating that medication should be given every morning during the 8:00 a.m. round by the nurse or attendant. Another colored coded strip such as blue could be used to indicate medication is to be given twice per day at 8:00 a.m. and 4:00 p.m. A different colored strip may indicate the medication is suppose to be given four times per day. While there is an infinite number of possibilities concerning types of medication and times that a patient would take the medication, the most commonly accepted practice in large facilities such as nursing homes, is to give the medication at the four time intervals previously indicated. By using the cassette-type dispenser as previously described, the pharmacist may fill the prescription for a given time interval, normally 1 month, and label the container with the colored coding to indicate the time the medication is to be given by the attendant. Thereafter, all the attendant has to do is simply dispense the medication as indicated on the front of the dispenser 10. At the end of each month, the dispenser 10 would be returned to the pharmacist for refilling and/or reuse.

Figure 1:
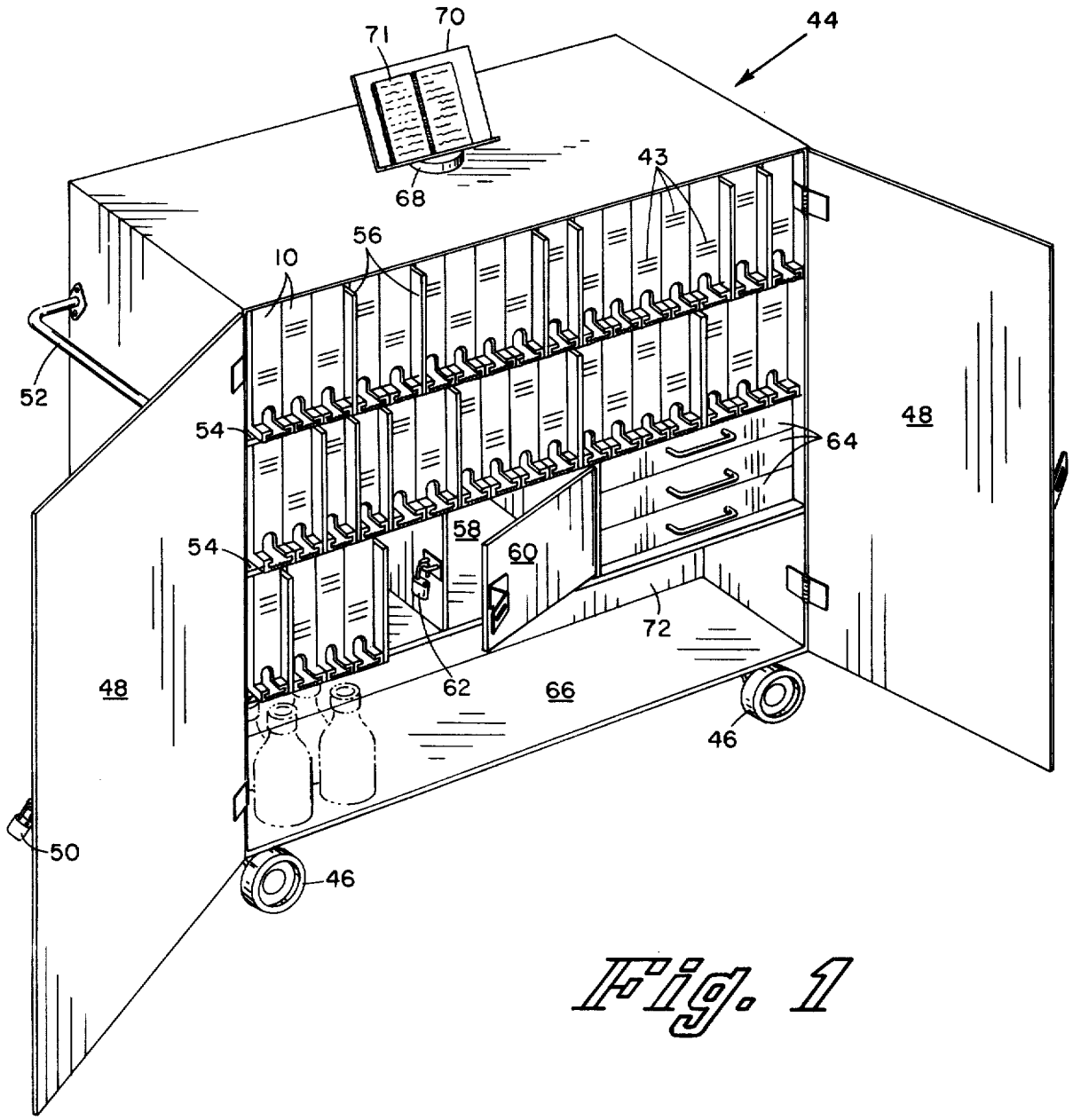
FIG. 1 is a perspective view of a portable dispensing cart for dispensing medication to a large number of individuals with the cart containing individual cassette-type dispensing units for strip packaged medication.

Referring now to FIG. 1 of the drawing, there is shown a portable cart 44 which may be used by hospitals or nursing homes for the dispensing of medication to the patients by the nurse. The portable cart 44 is a totally enclosed cabinet mounted on wheels 46 for ease of movement down a hall to the various patients' rooms. On each side of the portable cart, which is totally enclosed, are a pair of doors 48 which may be locked in the closed position by lock 50. A handle 52 is mounted on one end of the portable cart 44 for pushing the cart to the various locations. The inside of the portable cart 44 is specifically designed with a series of shelves 54 to receive the cassette-type dispensers 10 as shown in FIG. 1. Since the average patient in a nursing home receives more than four medications daily, a series of cassettes dispensers may be used for each patient. The color coding 43 would be located on the front of each dispenser for that particular patient. A patient divider 56 is used to separate one patient's strip packaged medication from the strip packaged medication of any other patient. While FIG. 1 only shows two shelves 54, it should be understood that any number of shelves that are necessary may be used. Also a double lock compartment 58 is located in the portable cart 44. By the locking of door 60 with lock 62, plus the locking of the outside doors 48, the controlled drugs can be maintained under double lock and key.

Also, a series of drawers 64 may be located in the portable cart 44 in which ointments or injectable medication may be contained. Another shelf 66 may be used in which to store liquid medication required by the patients.

On top of the portable cart 44 is permanently mounted a swivel base 68 to which is attached a record holder 70. When dispensing the medication, the nurse would simply put the record book 71 on the record holder 70 and proceed to dispense the medication to the patients as called for in the record book. The color coding on each of the cassette-type dispensers provides additional back-up to the record book to insure proper medication.

In the preferred embodiment, the portable cart 44 will also have lockable doors on the opposite side (not shown) very similar to that shown in FIG. 1 so that medication may be dispensed from either side of the portable cart 44 to rooms on either side of a hall in a nursing home. Divider wall 72 separates the left side of the portable cart 44 from the right side. After dispensing the medication, the portable cart 44 would be returned to the nurses' station with all the controlled drugs locked in double locked compartment 58, and the external doors 48 locked for the prescription drugs. All medication would be inexcessible except to the nurse who maintains the key as required by law.

One of the particular advantages of using the cassette-type dispenser in conjunction with the portable cart distribution system is that any unused medication may be saved and returned to the pharmacy for credit or reused provided the expiration date on the medication has not passed. This is a tremendous saving for nursing homes wherein a patient may not take his medication at a given time due to leave from the nursing home, changes in the doctor's orders, or innumerable other reasons. In the typical nursing home, there are approximately 200 types of medications in common use for the typical patient. The typical drugstore on the other hand has approximately 1700 different types of medication in stock.

I claim:

1. A system for dispensing medication to a large number of patients located in a health care facility, said system comprising:

a portable cart having a totally enclosed cabinet mounted on wheels;

first lockable doors on sides of said portable cart for locking said cabinet closed, said first lockable doors maintaining prescription drugs under a single lock;

lockable compartment within cabinet having a second lockable door thereon for maintaining controlled drugs therein under double lock;

refillable cassette-type dispensers located on dispenser shelves in said cabinet, said dispensers being used for dispensing strip packaged medication therefrom, a separate refillable dispenser being used for each strip packaged medication of each patient;

a first storage area in said cabinet for ointments and injectable drugs to be dispensed to said patients;

a second storage area in said cabinet for liquid medication to be dispensed to said patients; and means for maintaining a record on said portable cart of medications to be given to said patients;

each of said refillable cassette-type dispensers being color coded on the front thereof to indicate times for giving medication to a patient, all of each patient's strip packaged medication being maintained in a fixed position by divider means in said shelves;

said refillable cassette-type dispenser having an opening in the lower front thereof large enough for a finger to be inserted therethrough and move said strip packaged medication through a dispensing tab on the bottom front of said cassette-type dispenser, said cassette-type dispenser having a slidable cover maintained at the top thereof for refilling.

2. The system as recited in claim 1 wherein said maintaining means includes a swivel base for holding said record, said first lockable doors being located on both sides of said portable cart for dispensing medication from either side thereof.

* * * * *